US005458237A

United States Patent [19]

Kataoka

[11] Patent Number: 5,458,237

[45] Date of Patent: Oct. 17, 1995

[54] PACKAGING ASSEMBLY FOR PRODUCTS OF SMALL THICKNESS

[75] Inventor: Hachiro Kataoka, Nagoya, Japan

[73] Assignee: Chuoh Pack Industry Co., Ltd., Aichi, Japan

[21] Appl. No.: 243,797

[22] Filed: May 17, 1994

[30] Foreign Application Priority Data

Aug. 4, 1993 [JP] Japan ..... 5-193368

[51] Int. Cl.[6] ..... B65D 73/02; B65D 85/48; B65D 25/04

[52] U.S. Cl. ..... 206/723; 206/449; 206/454; 206/722; 229/120.24; 229/120.26; 493/162

[58] Field of Search ..... 206/334, 328, 206/449, 454, 329; 229/120.15, 120.16, 120.24, 120.26, 120.25, 120.36; 493/162

[56] References Cited

U.S. PATENT DOCUMENTS

| | | | |
|---|---|---|---|
| 3,023,010 | 2/1962 | Hoshino et al. | 206/454 X |
| 3,370,783 | 2/1968 | Nilsson | 206/454 X |
| 3,594,976 | 7/1971 | Jackson | 206/454 X |
| 3,921,890 | 11/1975 | Reihm | 206/454 |

FOREIGN PATENT DOCUMENTS

| | | | |
|---|---|---|---|
| 1160362 | 12/1963 | Germany | 206/329 |
| 5-294366 | 11/1993 | Japan . | |
| 6-156539 | 6/1994 | Japan . | |

*Primary Examiner*—Bryon P. Gehman
*Attorney, Agent, or Firm*—Lowe, Price, LeBlanc & Becker

[57] ABSTRACT

A set of sheets for producing a packaging assembly for products of small thickness, such as LCD panels, which comprises a first sheet (101) to fold into a product holding element (201), a second sheet (102) to fold into a base structure (202), and a third sheet (103) to fold into a cover member (203). Corrugated paper can be conveniently used for the sheets. No styrene foam is necessary.

11 Claims, 8 Drawing Sheets

PACKAGING ASSEMBLY FOR PRODUCTS OF SMALL THICKNESS

FIELD OF THE INVENTION

This invention relates to a packaging assembly for products of small thickness such as LCD panels.

BACKGROUND OF THE INVENTION

An assembly for packaging LCD panels, or liquid crystal display panels, is known that uses a check-patterned container constructed by folding sheets of corrugated paper and has square compartments in which to insert folded sheets of corrugated paper holding LCD panels therein. On the bottom of the container are placed packings of styrene foam to cushion the panel holders.

The process of producing the conventional assembly, including the manufacture of the necessary sheets, takes much time and trouble, however. Also, a relatively large amount of corrugated paper is necessary to produce the assembly. In addition, the assembly requires styrene foam to cushion the panel holders although such a material should not be used, if possible, for the product designed for disposal after use. Such a material is derived from petroleum, which is limited natural resources, and we should save such resources where possible.

SUMMARY OF THE INVENTION

Accordingly, it is an object of the invention to provide a packaging assembly for LCD panels or the like which is relatively easy to produce.

Another object of the invention is to provide a packaging assembly that requires only a relatively small amount of material.

Still another object of the invention is to provide a packaging assembly that does not require styrene foam.

A further object of the invention is to provide a set of sheets that enables one to produce a packaging assembly relatively easily.

According to the invention, there is provided a set of three sheets for producing a packaging assembly for products of small thickness, such as LCD panels. A first sheet is folded into a holding element; a second sheet, into a base structure; and a third sheet, into a cover member. No other materials, including styrene foam, is necessary. Corrugated paper, for example, can be used for the sheets.

In view of the necessity or desirability of saving limited natural resources, such as petroleum, the possibility of producing such an assembly from materials like corrugated paper is a significant contribution to society and industry. Also, such flat materials can be conveyed very conveniently to a place of producing assemblies. Moreover, such materials are inexpensive, as well as effectively protecting products like LCD panel from shock.

DETAILED DESCRIPTION OF THE PREFERRED EMBODIMENT

Figure 11:
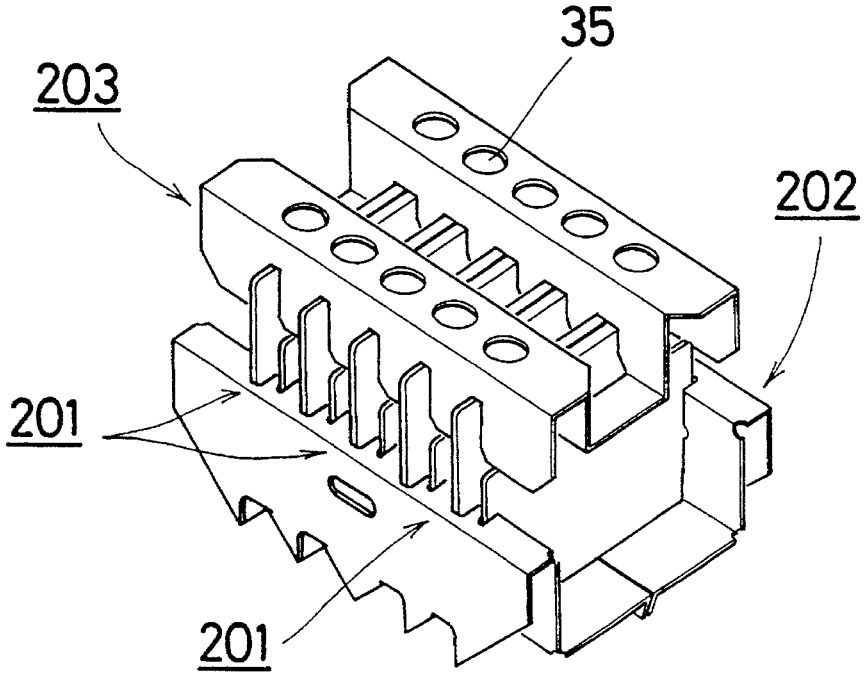

A packaging assembly of the invention is shown in FIG. 11. As shown, it comprises (a) a base structure 202, (b) plural product-holding elements 201 supported in upright positions by the base structure, and (c) a cover member 203 which holds the holding elements 201 together.

Figure 1:
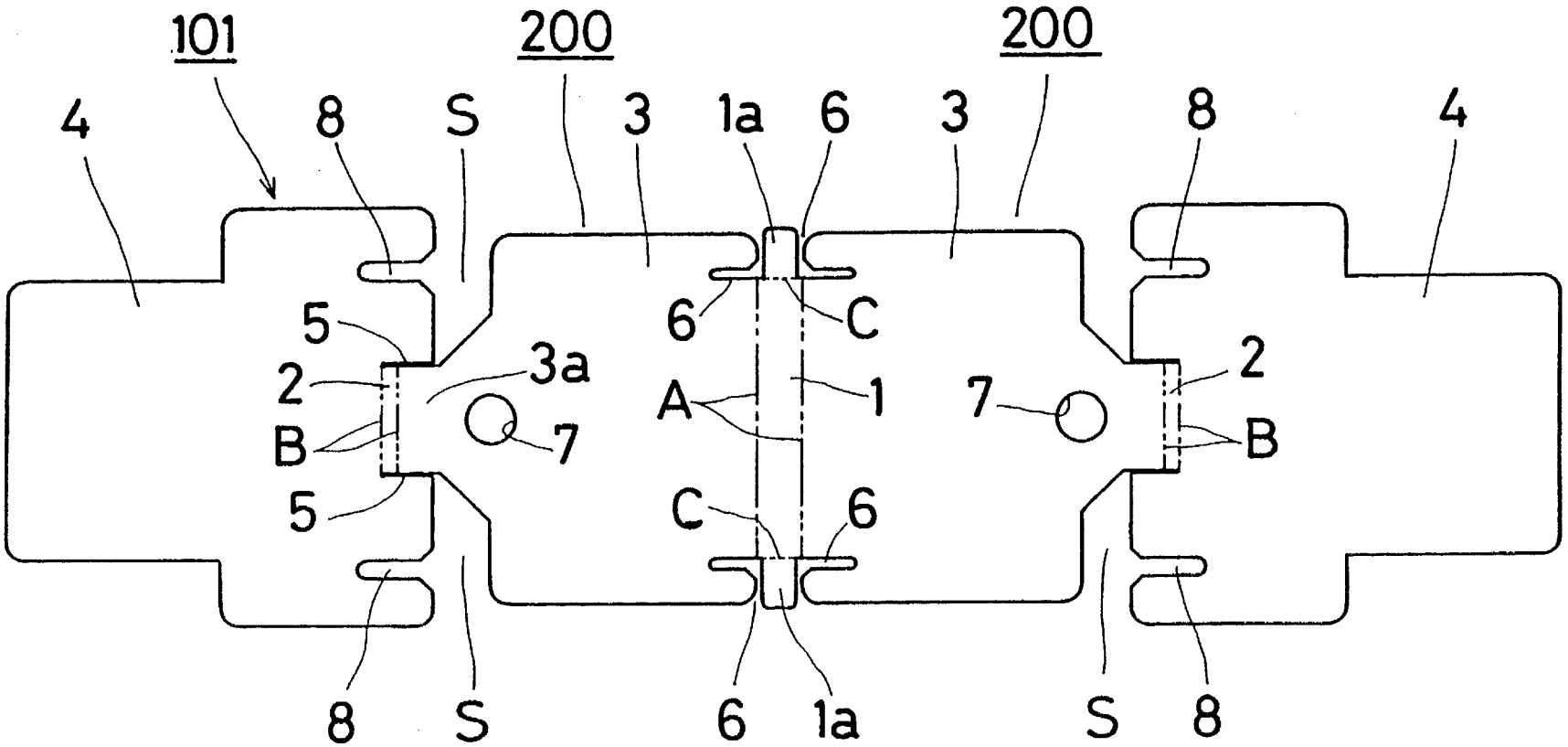
FIGS. 1, 2, and 3 illustrate how to fold a first sheet into a holding element.
Figure 2:
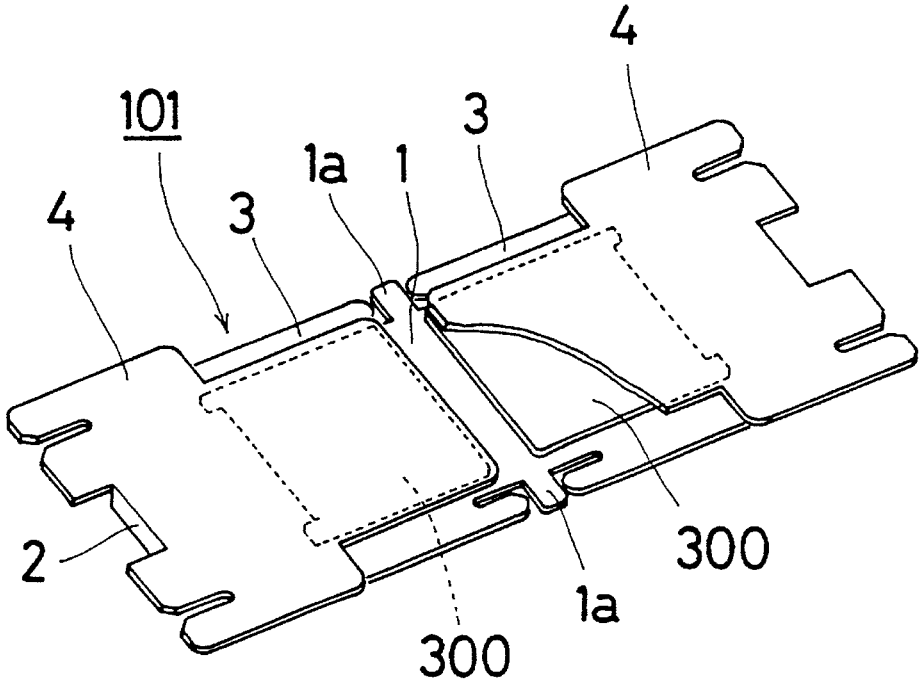
Figure 3:
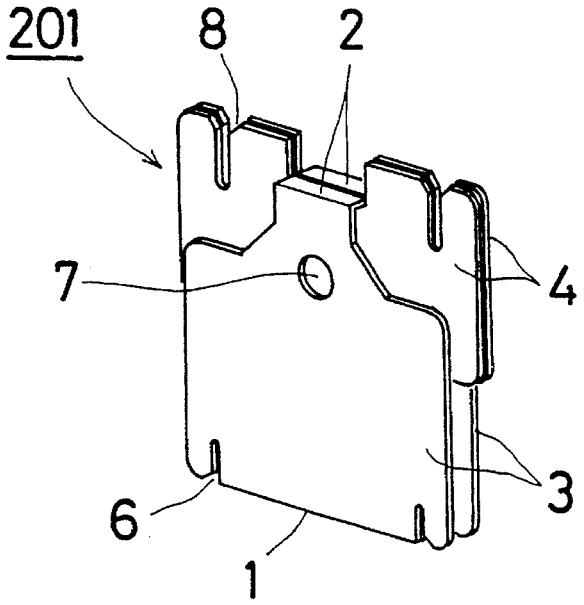

Product Holding Element (FIGS. 1–3)

The product holding elements 201 are identical elements and, therefore, only one element 201 will now be described in detail.

The holding element 201 is shown in FIG. 3. As will be described below, the holding element 201 holds two products of small thickness therein.

The holding element 201 is produced by folding a sheet 101 of FIG. 1. As clearly illustrated in FIG. 1, the sheet 101 has a shape symmetrical with respect to a central, bottom section 1 and, therefore, only one half 200 of it will be described. The central, bottom section 1 is chiefly defined by parallel transverse folding lines A, and has opposed smaller end portions 1*a*. Two folding lines C are formed between the end portions 1*a* and the rest of the bottom section 1, and make right angles with the folding lines A. Outside of the folding line A is located a first wall section 3. Slits 6 shaped generally like the letter "L" are formed between the first wall section 3 and the end portions la of the bottom section 1. The first wall section 3 has a tapered portion 3*a*, followed by a rectangular end portion. A circular opening 7 is made in the tapered portion 3*a*. Adjacent to the rectangular end portion of the first wall section 3 is located a very narrow top section 2 which is defined by two parallel folding lines B and upper and lower cuts 5. The two cuts 5 also form upper and lower edges of the rectangular end portion of the first wall section 3. An outermost section 4, or second wall section, embraces both the top section 2 and the rectangular end portion of the first wall section 3. The second wall section 4 has two slits 8. The second wall section 4 also has a smaller end portion. Two spaces S are located between the first and second wall sections 3 and 4.

The folding lines A, B, and C can be scored.

The sheet 101 has such a shape and construction.

In use, as shown in FIG. 2, two products 300 of small thickness, such as LCD panels, are first placed on the two first wall sections 3 of the sheet 101, respectively, and then the narrow top section 2 is folded along the inner one of the folding lines B to stand up the top section 2 and the second wall section 4. Then, the second wall section 4 is folded inward along the outer one of the folding lines B to cover the LCD panel 300 with the second wall section 4. This procedure should be understood very easily with reference to FIG. 2. Then, in FIG. 2, the two end portions la of the central, bottom section 1 are folded along the folding lines C (FIG. 1) to stand up the end portions la. Then, the two halves 200 of the sheet 101 are folded along the folding lines A to stand them up. The holding element 201 of FIG. 3 is thus obtained.

It will be appreciated that in this holding element 201 the end portions la of the bottom section 1 now stands between the two halves 200 and, hence, does not allow the second wall sections 4, now covering the products from inside, to touch each other hard. Thus, the end portions la serve to protect the LCD panels against damage. However, if such a danger of damage is most unlikely, one may omit the end portions la from the sheet 101.

As one can put his finger and thumb into the circular openings 7, he can handle the holding element 201 very easily.

As described above, the spaces S exist between the first and second wall sections 3 and 4 (FIG. 1). Folding the second wall section 4 from its position of FIG. 1 to that of FIG. 2, therefore, produces narrow openings between the two sections 3 and 4, through which openings one can see the product 300. Thus, one can see the contents 300 of the holding element 201 from outside.

The terms such as the "top" sections and "bottom" section used in the description of the sheet 101 of FIG. 1 have been chosen with reference to the completed holding element 201 of FIG. 3. So, as the terms suggest, in FIG. 3 the top sections 2 are in a higher position and the bottom section 1 is literally the bottom of the holding element 201.

Figure 4:
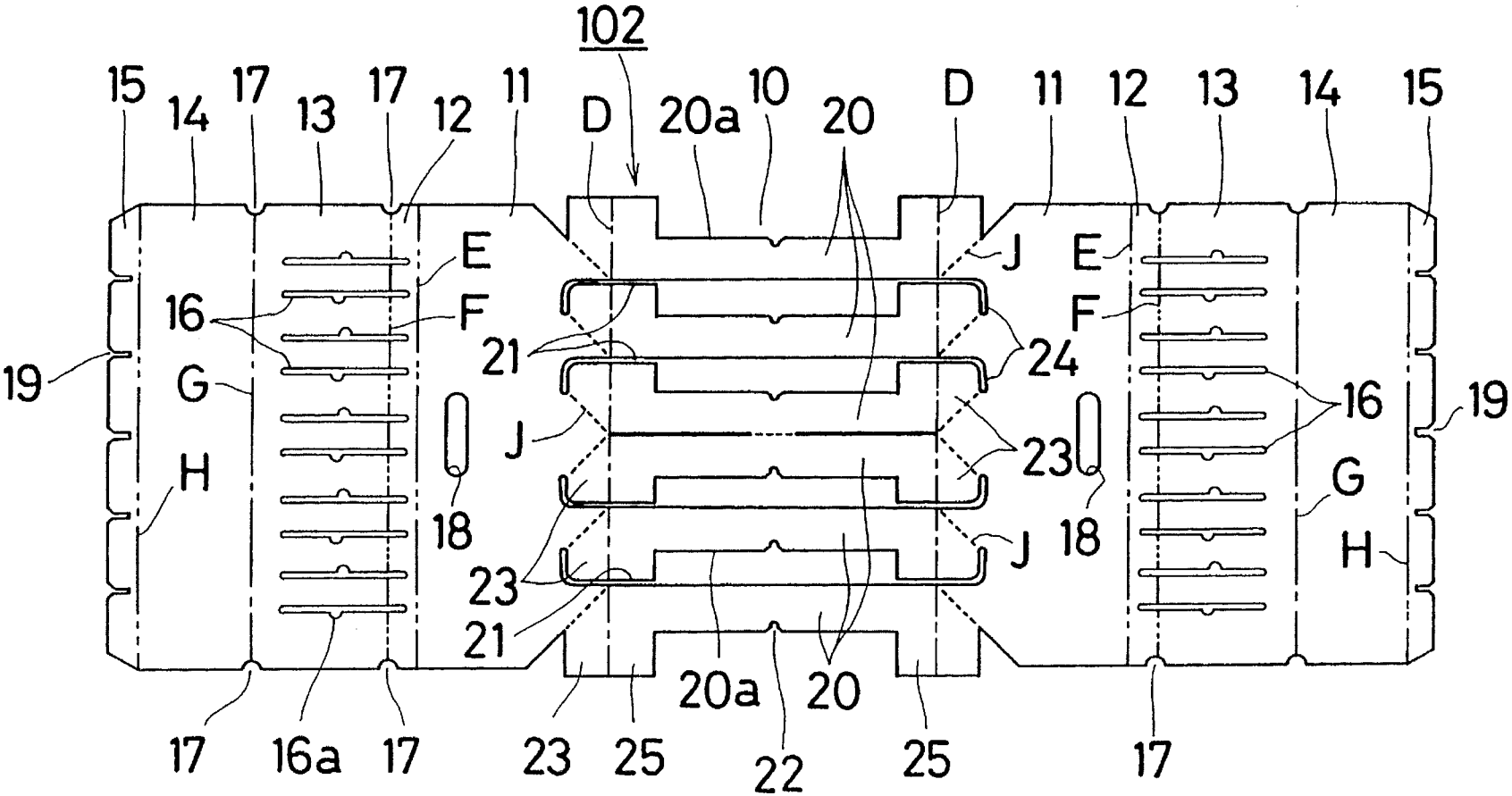
FIGS. 4, 5, and 6 illustrate how to fold a second sheet into a base structure.
Figure 5:
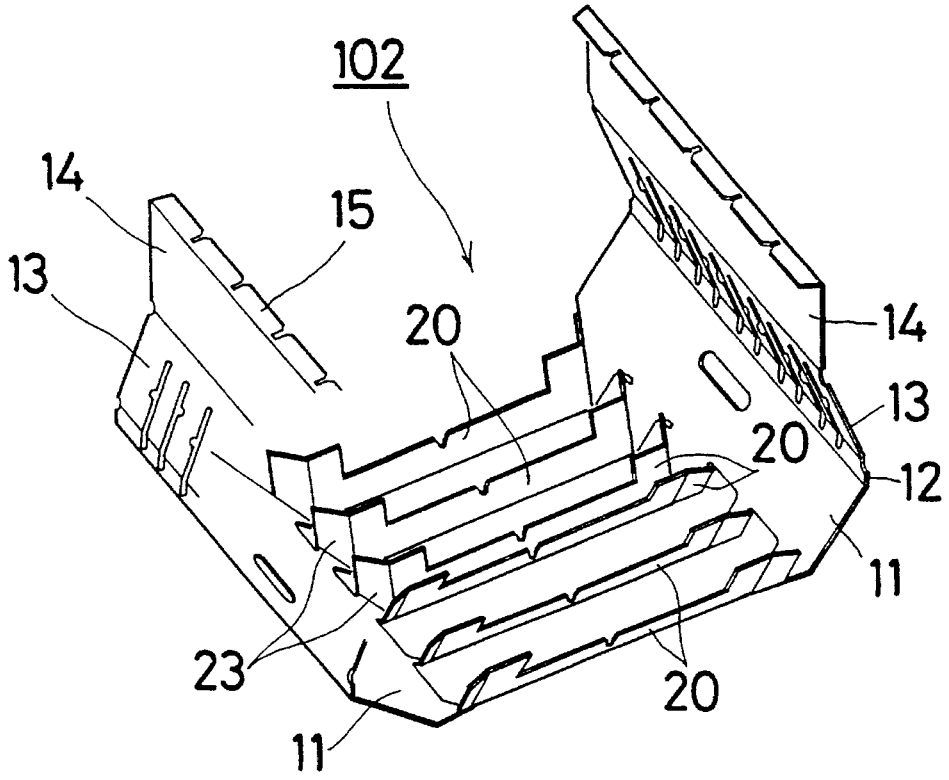
Figure 6:
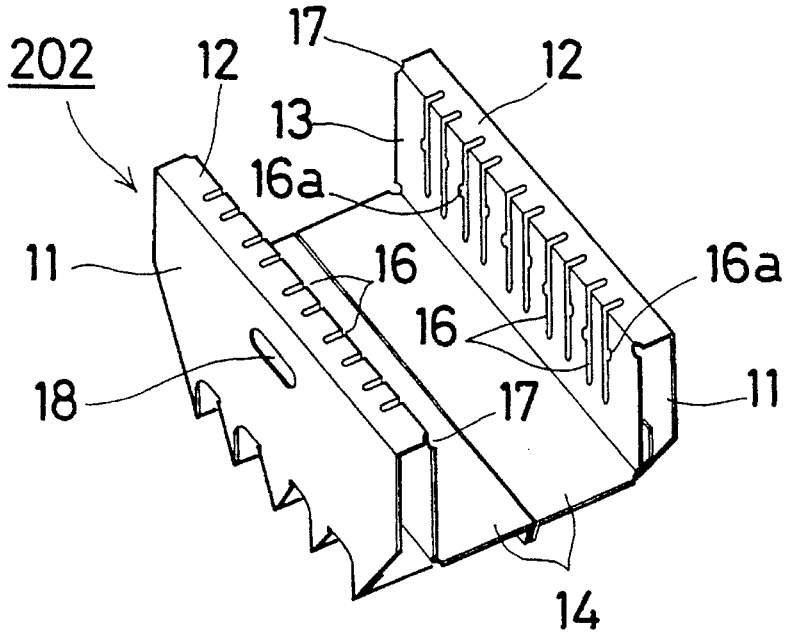

Base Structure (FIGS. 4–6).

The base structure 202 is shown in FIG. 6.

The base structure 202 is produced by folding a sheet 102 of FIG. 4.

The sheet 102 has a central, base section 10. This section 10 includes plural ribs 20 extending in the length direction of the sheet 102. Lower three ribs 20 are generally shaped like a gate, while upper three ribs 20 are shaped like an inverted gate. Thus, each rib 20 has a central recess 20*a*. Also, each rib 20 has a central notch 22. Also, the ribs 20 include parallel transverse folding lines D. Oblique folding lines J extend from the folding lines D at an angle of 45 degrees with the folding lines D. The folding lines J terminate at L-shaped slits 24, except for the four extreme ones J.

As clearly shown in FIG. 4, the sheet 102 has a shape substantially symmetrical with respect to the base section 10 and, thus, only one side of the base section 10 will now be described. Adjacent to the base section 10 is located a first wall section 11. The oblique folding lines J and the hook-shaped slits 24 are the borderline between the base section 10 and the first wall section 11. This section 11 has an elliptical opening 18, and terminates at a folding line E. Between this folding line E and a next folding line F is located a narrow top section 12. By the folding line F and a folding line G is defined a second wall section 13. Guide slits 16 stretch over both the top section 12 and the second wall section 13. Each slit 16 has a notch 16a. Also, the folding lines F and G have notches 17 at their both ends. A bottom section 14 is defined by the folding line G and a folding line H. A last, engaging section 15 has plural incisions 19.

The sheet 102 has such a shape and construction.

In use, in each side of the base section 10, the bottom section 14 is folded downward from the folding line G in advance until the bottom section 14 makes a right angle with the second wall section 13. Also in advance, the engaging section 15 is folded outward from the folding line H until the engaging section 15 makes a right angle with the bottom section 14. Then, the first wall sections 11 are folded downward from the folding lines D in order to facilitate the standing of the ribs 20. Then, the first wall sections 11 are folded upward from the folding lines D to stand up the first wall sections 11. As a result, as shown in FIG. 5, the ribs 20 also stand up. At the same time, the portions 23 of the ribs 20 located outside of the folding lines D come into contact with the first wall sections 11. Then, the top section 12 is folded inward from the folding line E until the top section 12 comes to a horizontal position. Then, the second wall section 13 is folded downward from the folding line F until the second wall section 13 becomes parallel with the first wall section 11. As a result, the bottom section 14 rests on the higher portions 25 of the ribs 20 and, at the same time, the incisions 19 of the engaging section 15 engage with the corresponding notches 22 of the ribs 20. Thus, a base structure 202 of FIG. 6 is produced.

As one can put his fingers into the openings 18 of the first wall sections 11, he can handle the base structure 202 very easily.

Figure 7:
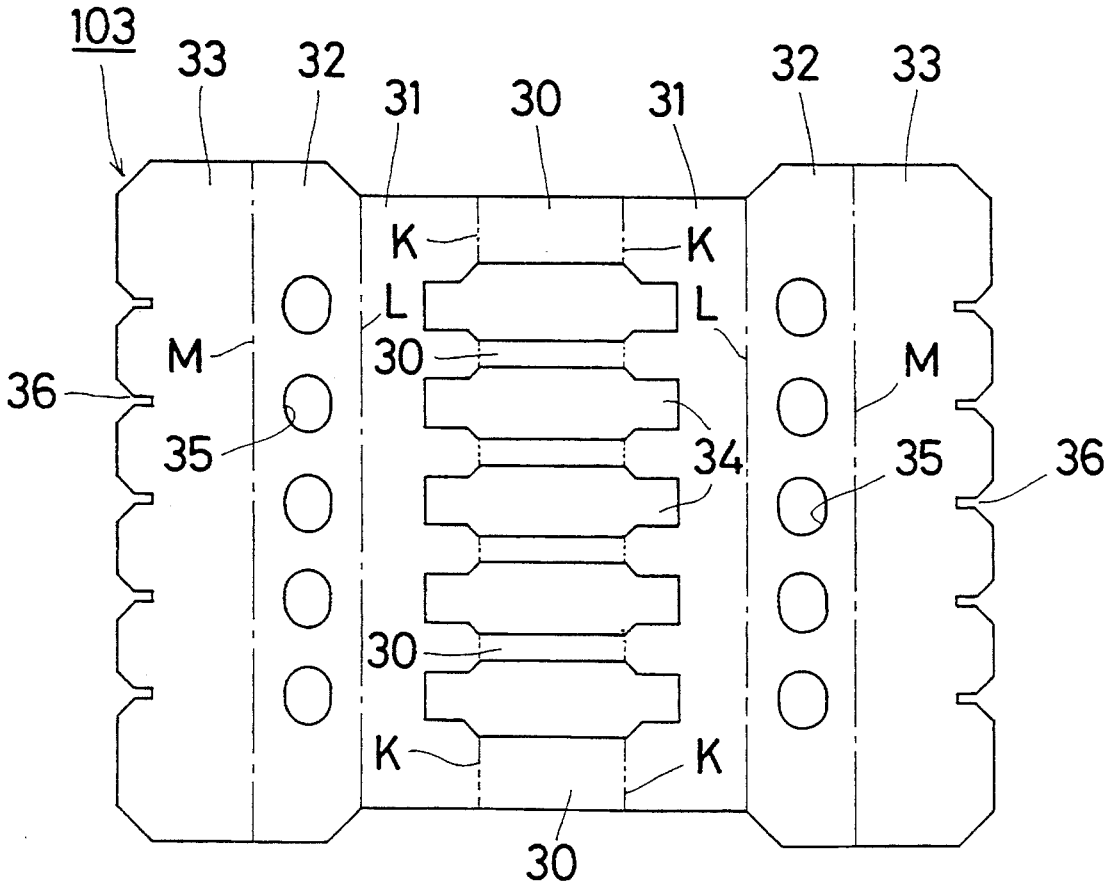
FIGS. 7, 8, and 9 illustrate how to fold a third sheet into a cover member.
Figure 8:
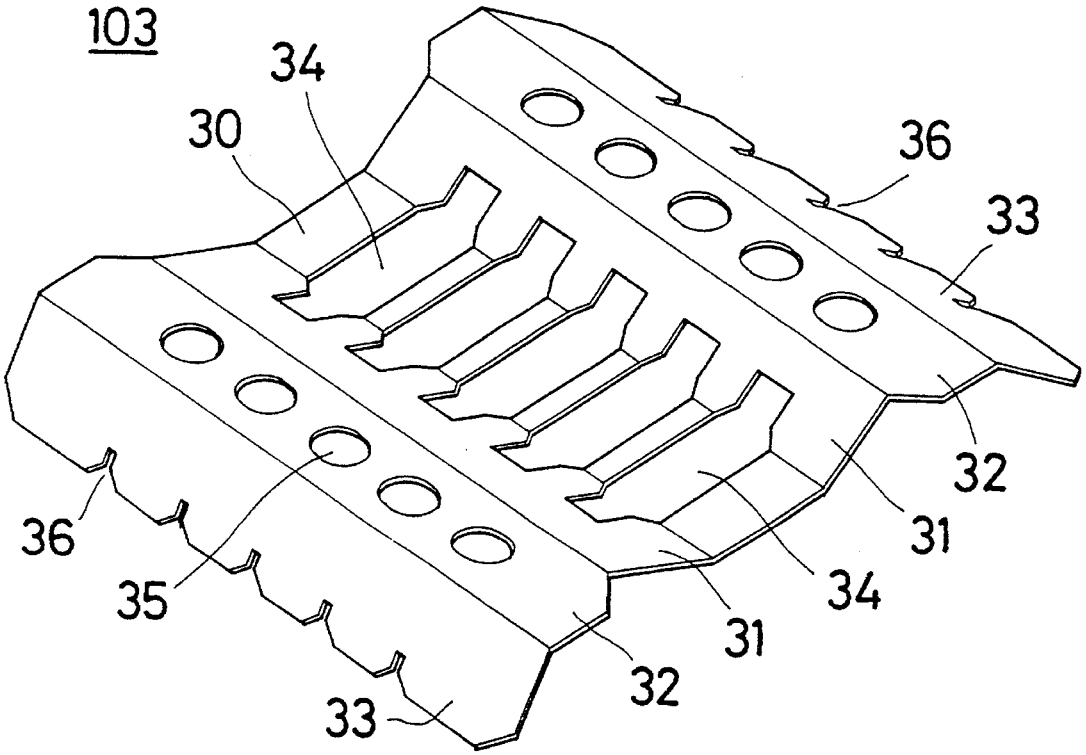
Figure 9:
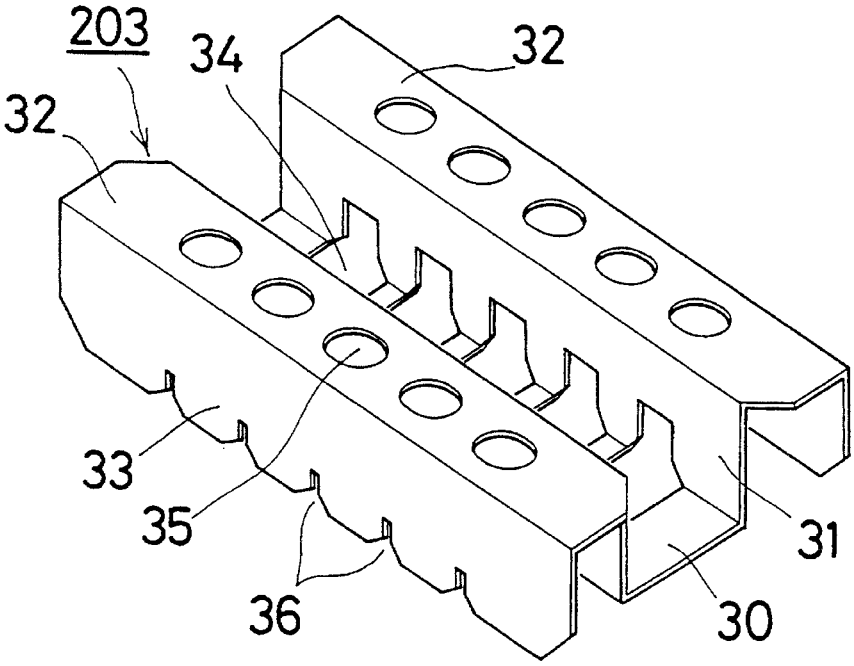

Cover Member (FIGS. 7–9)

The cover member 202 is shown in FIG. 9.

This member 202 is produced by folding a sheet 103 of FIG. 7.

The sheet 103 has central, bottom sections 30 spaced apart from each other by openings 34. The sheet 103 has a shape symmetrical with respect to the bottom sections 30 and, hence, only one half of it will be described. Adjacent to the bottom sections 30 is located an inner wall section 31. A folding line K, broken by the openings 34, is the borderline between the bottom sections 30 and the inner wall section 31. One end of each opening 34 is cutting into the inner wall section 31. The inner wall section 31 terminates at a folding line L. Between the folding line L and a folding line M is located a top section 32. This section 32 has plural circular openings 35. A last section is an outer wall section 33. This section 33 has plural incisions 36.

The sheet 103 has such a shape and construction.

In use, the inner wall section 31 is first folded upward from the folding line K. Then, the top section 32 is folded outward from the folding line L. Then, the outer wall section 33 is folded downward from the folding line M. Thus, the cover member 203 of FIG. 9 is obtained.

Figure 10:
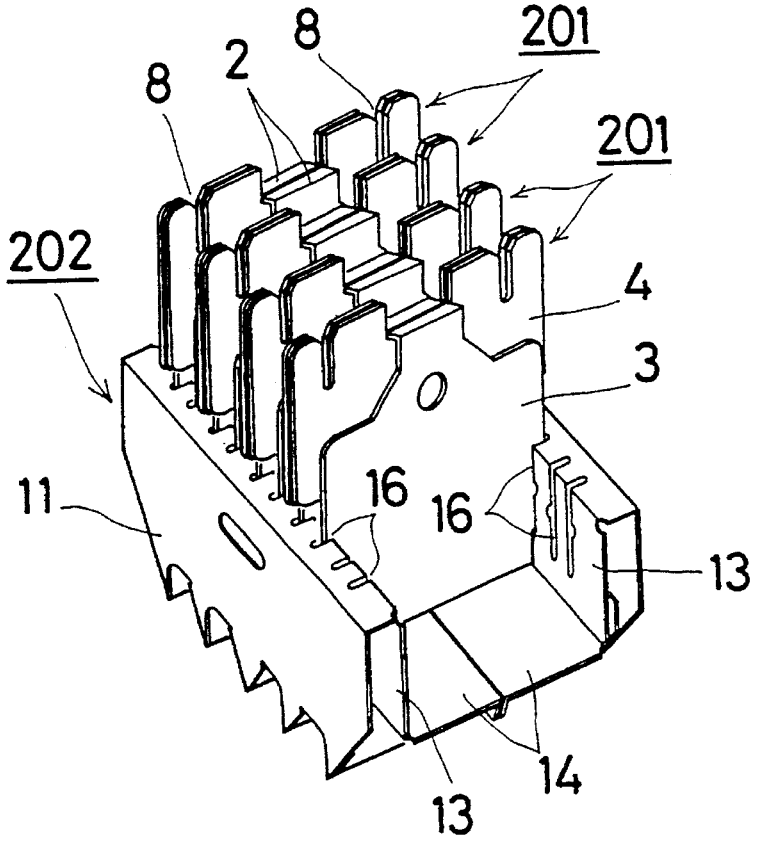
FIGS. 10 and 11 illustrate how to assemble the holding element, base structure, and cover member into a packaging assembly.

Packaging Assembly (FIGS. 10–11)

To produce the packaging assembly of FIG. 11, the holding element 201 of FIG. 3, holding two products 300 therein, is first inserted into the base structure 202, as shown in FIG. 10. To be exact, the two opposed first wall sections 3 of the holding element 201 are slid into two successive guide slits 16 of each wall of the base structure 202 until the first wall sections 3 touch the bottom of the base structure 202. As a result, each slit 6 of the holding element 201 engages with the bottom of the guide slit 16 and, thus, the holding element 201 is supported immovably in the base structure 202. Additional holding elements are inserted into the base structure 202 in the same manner. Thus, plural holding elements 201 are supported in the base structure 202. Then, the cover member 203 of FIG. 9 is put on the holding elements 201, as shown in FIG. 11. That is, each incision 36 of the cover member 203 is engaged with one of the slits 8. As a result, as shown in FIG. 11, each holding element 201 exposes its head from one of the openings 34 of the cover member 203. Thus, the packaging assembly of FIG. 11 is produced.

Since the slits 6 of the holding elements 201 are engaged with the bottoms of the guide slits 16, the holding elements 201 are unmovably supported in the base structure 202. In addition, the holding elements 201 are held together at their upper portions by the cover member 203.

Figure 12:
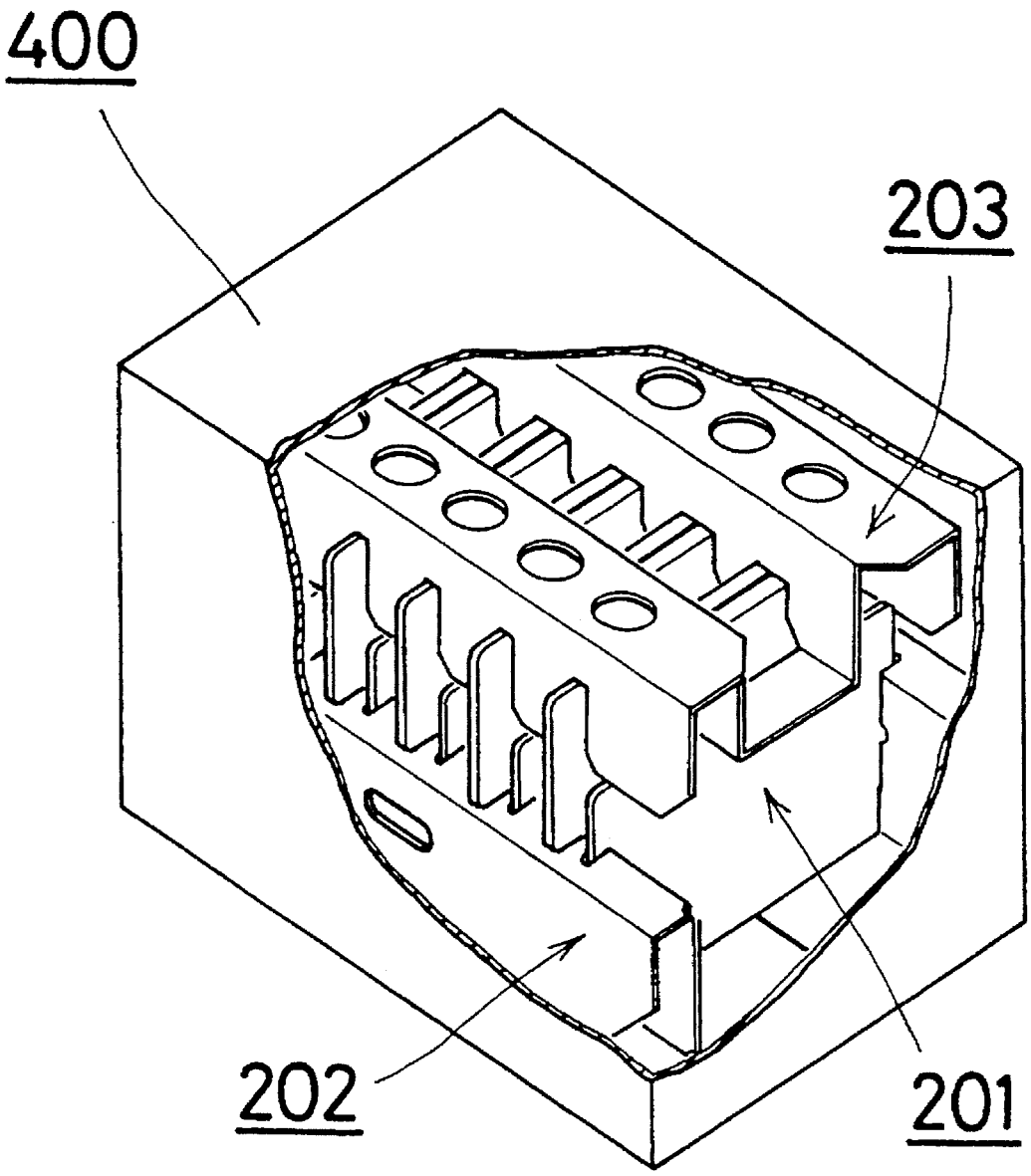
FIG. 12 shows a container for the packaging assembly.

The packaging assembly can be put into a container 400 of FIG. 12 for shipment. For example, a cardboard box may be used for the container 400.

As can be understood from FIG. 5, the bottom sections 14 of the base structure 202 are supported from below not by the whole of each rib 20 but only by its higher portions 25 (FIG. 4). Therefore, if the ribs 20 are given a shock during handling or transportation thereof, the shock is reduced before it may be transmitted to the holding elements 201.

Also, the notches 16a and 17 (FIG. 6) of the base structure 202, though only a little, serve to reduce a shock which may be given to the base structure 202.

As described before, one can see the contents 300 of the holding element 201 from outside, or from above in FIG. 3. Thus, one can look through the openings 35 (FIG. 11) of the cover member 203 to confirm that the holding elements 201 contain the products 300.

Material for the Sheets

Any suitable material can be used for the sheets 101, 102, and 103. Corrugated paper, among others, is particularly preferable, however, in view of its low cost, light weight, shock absorbing property, and the ease with which one can handle it.

Possible Modifications

Regarding FIG. 1 it has been stated that the end portions 1*a* may be omitted from the bottom section 1 of the sheet 101. Similarly, if it is not necessary to confirm the holding element 201 contains the products 300, both the spaces S of the sheet 101 and the openings 35 of the sheet 103 may be omitted. In addition, the omission of the openings 7 of the sheet 101 or the openings 18 of the sheet 102 would not affect the function of the packaging assembly.

What is claimed is:

1. A set of sheets for producing a packaging assembly to package products, comprising:

a first sheet (101) having a shape symmetrical with respect to a transverse centerline thereof and including (i) a central, bottom section (1) defined chiefly by two parallel transverse folding lines (A), (ii) a first wall section (3) located adjacent to said bottom section (1) and divided therefrom by one of said folding lines (A), said first wall section (3) having two L-shaped slits (6), (iii) a narrow top section (2) located adjacent to said first wall section (3) and defined by both two cuts (5) and two parallel folding lines (B), said cuts (5) also defining part of said first wall section (3), said top section (2) being divided from said first wall section (3) by an inner one of said folding lines (B), and (iv) a second wall section (4) divided from said first wall section (3) and said top section (2) by both said cuts (5) and an outer one of said folding lines (B), said second wall section (4) having two slits (8), a second sheet (102) having a shape symmetrical with respect to a transverse centerline thereof and including (v) a central, base section (10) including plural parallel ribs (20) extending in a length direction of the sheet (102), half of said ribs (20) each being shaped like a gate and each having a central recess (20*a*) and higher side support portions (25) and the remaining ribs (20) each being shaped like an inverted gate and each also having a central recess (20*a*) and higher side support portions (25), each said rib (20) also having a central notch (22), said base section (10) further including two parallel transverse folding lines (D) which stretch over all said ribs (20), each said rib (20) being partly defined by oblique folding lines (J) which extend from said folding lines (D) at an angle of 45 degrees with said folding lines (D), each of those oblique folding lines (J) that define middle ribs (20) terminating at a hook-shaped slit (24), (vi) a first wall section (11) located adjacent to said base section (10) and divided from said base section (10) by said oblique folding lines (J) and said hook-shaped slits (24), (vii) a top section (12) located next to said first wall section (11) and divided therefrom by a folding line (E), (viii) a second wall section (13) located next to said top section (12) and divided therefrom by a folding line (F), (ix) plural slits (16) stretching over both said top section (12) and said second wall section (13), (x) a bottom section (14) located next to said second wall section (13) and divided therefrom by a folding line (G), and (xi) an outermost, engaging section (15) located next to said bottom section (14) and divided therefrom by a folding line (H), said engaging section (15) having plural incisions (19) which each correspond to said central notch (22) of one of said ribs (20), and a third sheet (103) having a shape symmetrical with respect to a transverse centerline thereof and including (xii) central, bottom sections (30) spaced apart from each other by openings (34), each said bottom section (30) having opposed edges defined by two parallel transverse folding lines (K) which are broken by said openings (34), (xiii) an inner wall section (31) located adjacent to said bottom sections (30) and divided therefrom by one of said folding lines (K), one end of each said opening (34) cutting into said inner wall section (31), (xiv) a top section (32) located next to said inner wall section (31) and divided therefrom by a folding line (L), and (xv) an outer wall section (33) located next to said top section (32) and divided therefrom by a folding line (M), said outer wall section (33) having plural incisions (36) at its outer edge.

2. A set of sheets in accordance with claim 1 wherein said first wall section (3) of said first sheet (101) has an opening (7).

3. A set of sheets in accordance with claim 1 wherein said first wall section (11) of said second sheet (102) has an opening 18.

4. A set of sheets in accordance with claim 1 wherein said top section (32) of said third sheet (103) has plural openings (35).

5. A set of sheets in accordance with claim 1 wherein said folding line (F) of said second sheet (102) has notches (12) at its opposed ends, and each said slit (16) of said second sheet (102) also has a notch (16*a*).

6. A set of sheets in accordance with claim 1 wherein said sheets (101, 102 and 103) are sheets of corrugated paper.

7. A set of sheets in accordance with claim 1, wherein said packaging assembly comprises a package for a product having a small thickness.

8. A set of sheets in accordance with claim 1, wherein said packaging assembly comprises a package for an LCD panel.

9. A set of sheets in accordance with claim 1 wherein in said first sheet (101)

(i) said bottom section (1) has opposed end portions (1*a*) which are slightly narrower than a central portion thereof, said end portions (1*a*) being divided from said central portion by folding lines (C), (ii) said first wall section (3) has a tapered portion (3*a*), (iii) said tapered portion (3*a*) is followed by a rectangular end portion, (iv) said cuts (5) define opposed edges of said rectangular end portion, and (v) two spaces (S) are formed between said first and second wall sections (3 and 4).

10. A set of sheets in accordance with claim 9 wherein said top section (32) of said third sheet (103) has plural openings (35).

11. A method for producing a packaging assembly from the set of sheets of claim 10, which comprises the steps of (i) folding the bottom section (14) of the second sheet (102) downward from the folding line (G), as a preliminary step, until the bottom section (14) makes a right angle with the second wall section (13), (ii) folding the engaging section (15) of the second sheet (102) outward from the folding line (H), also as a preliminary step, until the engaging section (15) makes a right angle with the bottom section (14), (iii) folding the first wall sections (11) of the second sheet (102) downward from the folding lines (D) in order to facilitate the standing of the ribs (20), (iv) folding the first wall sections (11) upward from the folding lines (D) to stand up the first wall sections (11), so that the ribs (20) also stand up and at the same time portions (23) of the ribs (20) located outside of the folding lines (D) come into contact with the first wall sections (11), (v) folding the top section (12) of the second sheet (102) inward from the folding line (E) until the top section (12) comes to a horizontal position, (vi) folding the second wall section (13) of the second sheet (102) downward from the folding line (F) until the second wall section (13) becomes parallel with the first wall section (11), with the result that the bottom section (14) rests on the higher support portions (25) of the ribs (20) and at the same time the incisions (19) of the engaging section (15) engage with the central notches (22) of the corresponding ribs (20), whereby a base structure (202) is provided, said base structure (202) having two opposed support walls with L-shaped guide slits as formed by said slits 16, said guide slits of one of said support walls each being opposed directly to one of said guide slits of the other support wall, said base structure (202) also having a bottom as formed by the bottom sections (14), (vii) placing two products (300) of small thickness, such as LCD panels, on the two first wall sections (3) of the first sheet (101), respectively, (viii) folding the narrow top section (2) of the first sheet (101) along the inner one of the folding lines (B) to stand up both the top section (2) and the second wall section (4), (ix) folding the second wall section (4) inward along the outer one of the folding lines (B) to cover the product (300) with the second wall section (4), (x) folding the end portions (1*a*) of the bottom section (1) of the first sheet (101) along the folding lines (C) to stand up the end portions (1*a*), (xi) folding the two halves (200) of the first sheet (101) along the folding lines (A) to make the two second wall sections (4) face each other, whereby a holding element (201), holding the two products (300) therein, is provided, said holding element (201) having upper slits as formed by said slits (8) and lower slits as formed by said L-shaped slits (6), said end portions (1*a*) of the bottom section (1) being in upright positions between the two halves (200) of said holding element (201), so that said end portions (1*a*) prevent the two second wall sections (4), now covering the products (300) from inside, from touching each other hard, thereby protecting the products (300) against damage, (xii) repeating the above steps (vii) to (xi) by using additional first sheets (101), thus providing additional holding elements (201), (xiii) folding the inner wall section (31) of the third sheet (103) upward from the folding line (K) to stand up the inner wall section (31), (xiv) folding the top section (32) of the third sheet (103) outward from the folding line (L) until the top section (32) comes to a horizontal position, (xv) folding the outer wall section (33) of the third sheet (103) downward from the folding line (M), whereby a cover member (203) is provided, (xvi) sliding the two opposed first wall sections (3) of each holding element (201) into two successive guide slits (16) of each said support wall of the base structure (202) until the lower slits (6) of the holding element (201) engage with the bottoms of the guide slits (16), whereby each holding element (201) is immovably supported on the bottom of the base structure (202), and (xvii) engaging each incision (36) of the cover member (203) with one of the upper slits (8) of the holding elements (201), whereby each holding element (201) exposes its head from one of the openings (34) of the cover member (203), and the cover member (203) holds the upper portions of the holding elements (201) together, and whereby a packaging assembly is produced.

* * * * *